US011898833B2

(12) United States Patent
Oltmanns et al.

(10) Patent No.: US 11,898,833 B2
(45) Date of Patent: Feb. 13, 2024

(54) CASE JACKET

(71) Applicants: Nitrochemie Aschau GmbH, Aschau (DE); Rheinmetall Waffe Munition GmbH, Unterluess (DE)

(72) Inventors: Jens Oltmanns, Waldkraiburg (DE); Ulrich Focken, Waldkraiburg (DE); Dirk Brachmann, Celle (DE); Stephan Thiesen, Krefeld (DE); Michael Vagedes, Sudheide (DE); Luca Linus Schnackenberg, Luneburg (DE)

(73) Assignees: Nitrochemie Aschau GmbH, Aschau (DE); Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 17/797,614

(22) PCT Filed: Feb. 10, 2021

(86) PCT No.: PCT/EP2021/053158
§ 371 (c)(1),
(2) Date: Aug. 4, 2022

(87) PCT Pub. No.: WO2021/165109
PCT Pub. Date: Aug. 26, 2021

(65) Prior Publication Data

US 2023/0054010 A1 Feb. 23, 2023

(30) Foreign Application Priority Data

Feb. 19, 2020 (DE) ..... 10 2020 001 052.0

(51) Int. Cl.
*F42B 5/18* (2006.01)
*F42B 5/192* (2006.01)

(52) U.S. Cl.
CPC ..... *F42B 5/181* (2013.01); *F42B 5/192* (2013.01)

(58) Field of Classification Search
CPC .. F42B 5/18; F42B 5/181; F42B 5/182; F42B 5/192
(Continued)

(56) References Cited

U.S. PATENT DOCUMENTS 4,159,678 A * 7/1979 Luther ..... F42B 5/181 102/431
4,763,577 A * 8/1988 Romer ..... F42C 19/0826 102/431
(Continued)

FOREIGN PATENT DOCUMENTS

DE 3009842 A1 9/1981
EP 0429753 A1 6/1991
(Continued)

OTHER PUBLICATIONS

Written Opinion and International Search Report, dated May 28, 2021, in International application No. PCT/EP2021/053158, filed on Feb. 10, 2021 (11 pages).

*Primary Examiner* — John Cooper
(74) *Attorney, Agent, or Firm* — McAndrews, Held & Malloy, Ltd.; Michael S. Tomsa

(57) ABSTRACT

A case jacket made of a felted, in particular combustible fibrous material, comprising a cylindrical case jacket portion and a calotte-shaped case bottom which is connected to an end of the cylindrical case jacket portion, wherein the bottom-side end of the case jacket portion has a first inside diameter and a first outside diameter, and wherein the case bottom has an annular connecting edge towards the case jacket portion, which has a second inside diameter that is smaller than the first inside diameter, and a second outside diameter which is smaller than the second outside diameter,
(Continued)

Figure 1:
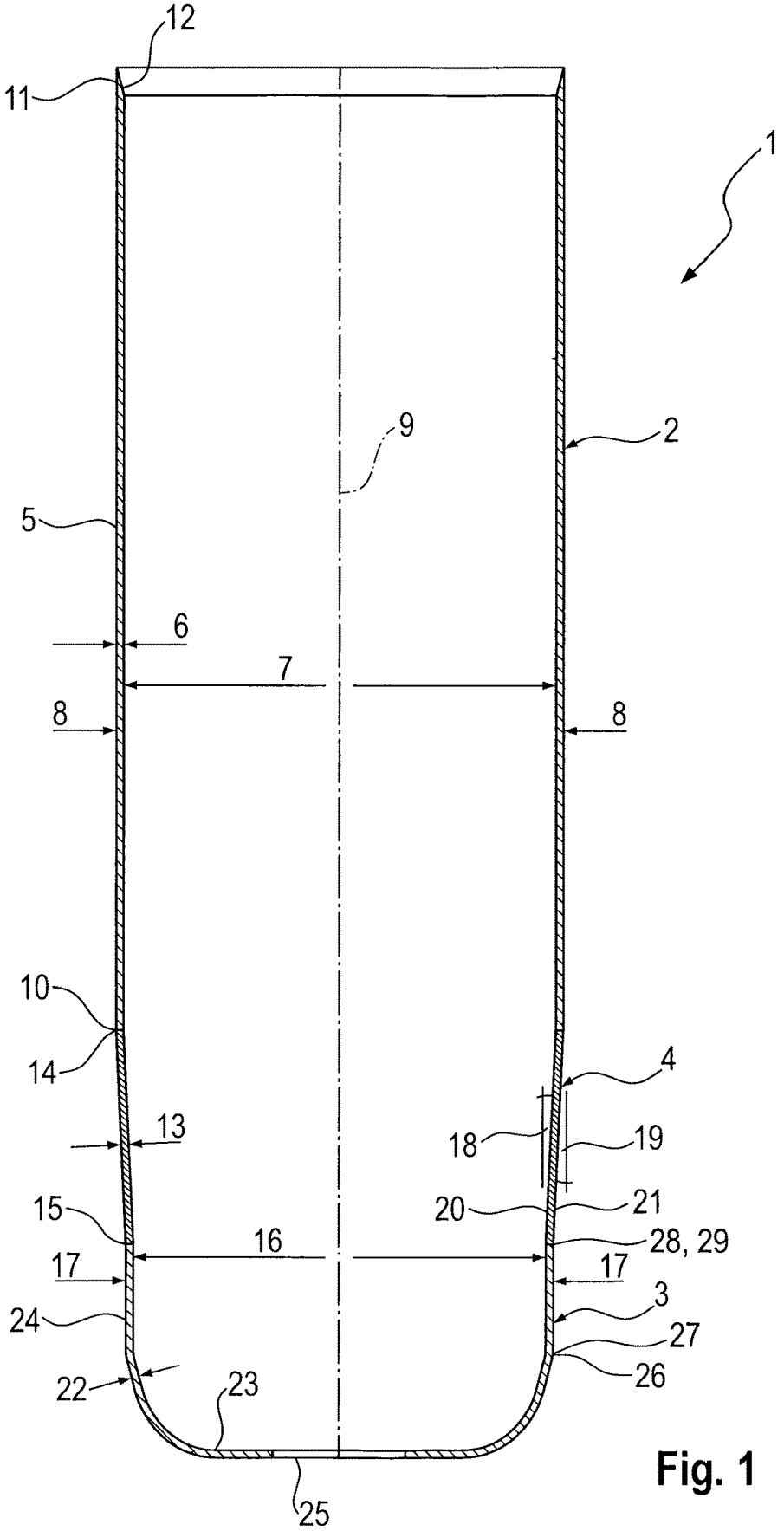

includes a conical connecting portion whose one end has the first inside diameter and the first outside diameter and is connected to the bottom-side end of the case jacket portion, and whose other end has the second inside diameter and the second outside diameter and is connected to the connecting edge of the case bottom, wherein the angle of inclination of the inner wall and the angle of inclination of the outer wall of the conical connecting portion with respect to the cylinder axis are not more than 10°.

20 Claims, 2 Drawing Sheets

(58) Field of Classification Search
USPC ..... 102/431
See application file for complete search history.

(56) References Cited

U.S. PATENT DOCUMENTS 4,887,534 A * 12/1989 Dickovich ..... F42C 19/0826 102/373
4,928,598 A * 5/1990 Sabranski ..... F42B 5/181 102/431
5,259,288 A 11/1993 Vatsvog
5,563,365 A * 10/1996 Dineen ..... F42B 5/18 102/431
5,841,062 A * 11/1998 Manole ..... F42B 5/18 102/466
6,408,764 B1 * 6/2002 Heitmann ..... F42B 5/18 102/431
7,913,625 B2 * 3/2011 Mutascio ..... F42B 5/18 102/431
8,776,690 B2 * 7/2014 Lebacher ..... F42B 5/188 86/19.5
11,118,874 B2 * 9/2021 Huber ..... F42B 5/188
2006/0096485 A1 * 5/2006 Stark ..... F42C 19/0826 102/431
2012/0318161 A1 * 12/2012 Mutascio ..... F42B 5/181 102/431

FOREIGN PATENT DOCUMENTS

JP S5649900 A 5/1981
WO 2009018899 A1 2/2009
WO 2011015346 A1 2/2011

* cited by examiner

CASE JACKET

This application is a 371 of International Patent Application No. PCT/EP2021/053158, filed Feb. 10, 2021, which claims benefit of German Patent Application No. 10 2020 001 052.0, filed to the German Patent Office on Feb. 19, 2020, entitled "Case Jacket," contents of both of which are hereby incorporated by reference in their entirety.

This invention relates to a case jacket of felted, in particular combustible, fibrous material, comprising a cylindrical case jacket portion and a calotte-shaped case bottom which is connected to an end of the cylindrical case jacket portion, wherein the bottom-side end of the case jacket portion has a first inside diameter and a first outside diameter, and wherein the case bottom has an annular connecting edge towards the case jacket portion, which has a second inside diameter that is smaller than the first inside diameter and a second outside diameter that is smaller than the first outside diameter.

Such case jackets have long since been known as part of ammunition for firearms and serve to receive propellant powder. In these case jackets, the case bottom adjoins an end of the case jacket portion with a circumferential step protruding radially to the outside. During the further manufacture of the ammunition, a metal bottom is put onto the outside of the case bottom, which encloses the case bottom and extends up to the step.

It is known to manufacture such case jackets in particular from nitrocellulose and pulp. These materials have the advantage that a case jacket manufactured therefrom is combustible. Thus, after firing, no case residues must be removed before the next shot; only the metal bottom is ejected.

However, case jackets manufactured from such a material are sensitive to shock. At relatively low fall heights already cracks are formed in the wall of the case jacket so that its further use for the manufacture of ammunition is no longer possible or, when finished ammunition is dropped, this ammunition is no longer usable.

It is the object of the present invention to reduce the shock sensitivity of generic case jackets.

According to the invention, this object is achieved in a case jacket as mentioned above by a conical connecting portion whose one end has the first inside diameter and the first outside diameter and adjoins the bottom-side end of the case jacket portion, and whose other end has the second inside diameter and the second outside diameter and is connected to the connecting edge of the case bottom, wherein the angle of inclination of the inner wall and the angle of inclination of the outer wall of the conical connecting portion with respect to the cylinder axis are not more than 10°.

With the measures according to the invention, the risk of the formation of cracks in the finished ammunition both with an empty case jacket and with a case jacket filled with propellant powder can be reduced considerably, and this also at relatively large fall heights. The invention is based on the finding that—when a case jacket or ammunition is dropped by mistake and the case jacket then is ruptured—this crack frequently starts in the transition area between case jacket portion and case bottom. It has been found that with an arrangement of a conical connecting portion between case jacket portion and case bottom the formation of cracks can be reduced by at least 50% up to a fall height of at least 2 m regardless of the size of the diameter and/or the wall thickness of the case jacket portion and the case bottom, when the angle of inclination of the inner wall and that of the outer wall of the cone with respect to the longitudinal axis of the cylinder are not more than 10°.

Preferably, these angles of inclination are not more than 7° and preferably not more than 3°. The risk of the formation of cracks is further reduced thereby and/or the tolerable fall height is greater, while the probability of the occurrence of a crack remains the same.

In an advantageous embodiment of the invention, the case bottom includes a cylindrical case bottom portion on its side facing the case jacket portion, and the annular connecting edge of the case bottom forms the end of the cylindrical case bottom portion facing the case jacket portion. In this way, the case jacket can easily be adapted to different requirements, as the length of the cylindrical case bottom portion in the direction of the cylinder axis can easily be adapted to the respective circumstances.

Preferably, the wall thickness at the bottom-side end of the case jacket portion is equal to the wall thickness of the connecting ring of the case bottom. As a result, the technical effort for manufacturing the case jacket is considerably simplified.

The case jacket likewise preferably has a wall thickness which is constant in the circumferential direction and in the longitudinal direction except for a chamfer at the end of the case jacket portion facing away from the bottom. The expenditure of time and costs for the manufacture of a case jacket according to the invention thereby is further reduced considerably.

In a favorable development of the invention, a textile fabric is embedded in the wall of the case jacket. This reduces the risk that a crack is obtained outside the transition area between case jacket portion and case bottom or that a crack propagates over a larger distance into the case jacket portion and/or into the case bottom.

Figure 2:
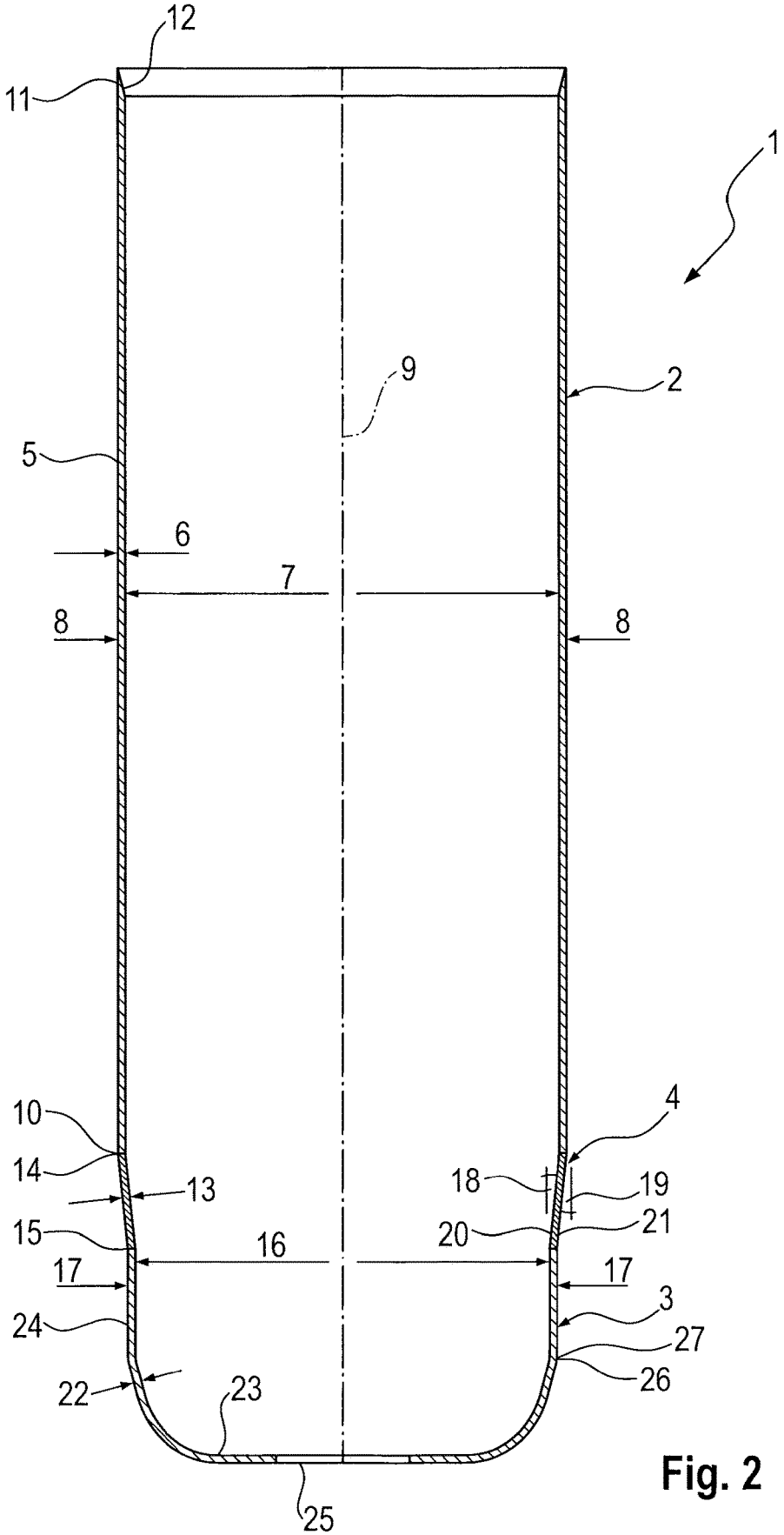

The invention will subsequently be explained in greater detail by way of example with reference to the drawings, in which:

FIGS. 1 and 2 each show a longitudinal section through a first and a second embodiment of a case jacket according to the invention.

The exemplary embodiments of inventive case jackets 1 shown in the Figures include a case jacket portion 2 and a case bottom 3 as well as a conical connecting portion 4 between the same. All three of them are made of a felted, combustible fibrous material which is formed for example from nitrocellulose and pulp. In the wall 5 of the case jacket 1 a textile fabric (not shown here) can be embedded.

The case jacket portion 2 is a cylinder which has a constant wall thickness 6 in circumferential direction and in longitudinal direction with a first inside diameter 7 and a first outside diameter 8; its cylinder axis is designated with reference numeral 9. To a first end 10—in the Figures the lower end—of the case jacket portion 2 the conical connecting portion 4 is connected. To the other (second) end 11—in the Figures the upper end—further parts of the ammunition will be connected, and for this purpose a chamfer 12 is formed.

The conical connecting portion 4 is arranged coaxially with respect to the case jacket portion 2 and has a constant wall thickness 13 in circumferential direction and in longitudinal direction, which is identical with that of the case jacket portion 2. The one end 14 of the connecting portion 4 is connected to the first end 10 of the case jacket portion 2 and has the first inside diameter 7 and the first outside diameter 8. The other end 15 of the connecting portion 4 is connected to the case bottom 3 and has a second inside diameter 16 which is smaller than the first inside diameter 7, and a second outside diameter 17 which is smaller than the first outside diameter 8.

The angles of inclination 18, 19 of the inner wall 20 and the outer wall 21 of the conical connecting portion 4 with respect to the cylinder axis 9 are the same due to the constant wall thickness 13 and amount to 3° in the case of FIGS. 1 and 7° in the case of FIG. 2.

The case bottom 3 is arranged coaxially to the case jacket portion 2 and to the conical connecting portion 4 and has a constant wall thickness 22 in circumferential direction and in longitudinal direction, which is identical with the wall thickness 6 of the case jacket portion 2 and with the wall thickness 13 of the conical connecting portion 4. The case bottom 3 is formed from a calotte-shaped case bottom portion 23 and a cylindrical case bottom portion 24.

In the calotte-shaped case bottom portion 23 an opening 25 coaxial to the cylinder axis 9 is formed, which receives the igniter (not shown). The annular edge 26 of the calotte-shaped case bottom portion 23 faces the conical connecting portion 4 and has the second inside diameter 16 and the second outside diameter 17.

This edge 26 is adjoined by the cylindrical case bottom portion 24 with an end 27. The case bottom portion 24 likewise has the second inside diameter 16 and the second outside diameter 17. Its other end 28 faces the conical connecting portion 4 and is connected to the same and thus forms an annular connecting edge 29 of the case bottom 3 towards the conical connecting portion 4.

The invention claimed is:

1. A case jacket made of felted, in particular combustible fibrous material, the case jacket comprising:

a cylindrical case jacket portion;

a calotte-shaped case bottom that is connected to one end of the cylindrical case jacket portion, wherein a bottom-side end of the cylindrical case jacket portion has a first inside diameter and a first outside diameter, and wherein the calotte-shaped case bottom has an annular connecting edge towards the cylindrical case jacket portion, which has a second inside diameter that is smaller than the first inside diameter and a second outside diameter that is smaller than the first outside diameter; and a conical connecting portion having an inner wall and an outer wall, wherein one end of the conical connecting portion has the first inside diameter and the first outside diameter and is connected to the bottom-side end of the cylindrical case jacket portion, and whose other end has the second inside diameter and the second outside diameter and is connected to the connecting edge of the calotte-shaped case bottom, wherein an angle of inclination of the inner wall and an angle of inclination of the outer wall of the conical connecting portion with respect to a cylinder axis are not more than 10 degrees.

2. The case jacket according to claim 1, wherein the angle of inclination of the inner wall and the angle of inclination of the outer wall are not more than 7 degrees.

3. The case jacket according to claim 1, wherein the calotte-shaped case bottom has a cylindrical case bottom portion on its side facing the cylindrical case jacket portion, and the annular connecting edge of the calotte-shaped case bottom forms the end of the cylindrical case bottom portion facing the cylindrical case jacket portion.

4. The case jacket according to claim 1, wherein a wall thickness at the bottom-side end of the cylindrical case jacket portion is equal to a wall thickness of the connecting ring of the calotte-shaped case bottom.

5. The case jacket according to claim 4, wherein, except for a chamfer at the end of the cylindrical case jacket portion facing away from the bottom, the case jacket has a constant wall thickness both in circumferential direction and in longitudinal direction.

6. The case jacket according to claim 1, wherein a textile fabric is embedded in a wall of the cylindrical case jacket portion.

7. The case jacket according to claim 1, wherein the angle of inclination of the inner wall and the angle of inclination of the outer wall are not more than 3 degrees.

8. The case jacket according to claim 1, wherein the calotte-shaped case bottom is configured to be assembled with a bottom such that, when assembled, the calotte-shaped case bottom resides within a cavity defined by the bottom and the conical connecting portion resides outside of the cavity.

9. A case jacket comprising:

a cylindrical case jacket portion, wherein a bottom-side end of the cylindrical case jacket portion defines a first inside diameter and a first outside diameter;

a calotte-shaped case bottom portion, wherein an annular connecting edge of the calotte-shaped case bottom portion defines a second inside diameter that is smaller than the first inside diameter and a second outside diameter that is smaller than the first outside diameter; and a conical connecting portion that joins the cylindrical case jacket portion with the calotte-shaped case bottom portion, wherein a first end of the conical connecting portion is connected to the bottom-side end, wherein a second end of the conical connecting portion is connected to the annular connecting edge, wherein an angle of inclination of a wall between the first end and the second end is 10 degrees or less relative to a cylinder axis of the conical connecting portion.

10. The case jacket according to claim 9, wherein the angle of inclination of the wall is 7 degrees or less.

11. The case jacket according to claim 9, wherein the angle of inclination of the wall is 3 degrees or less.

12. The case jacket according to claim 9, wherein the calotte-shaped case bottom portion has a cylindrical case bottom portion on its side facing the cylindrical case jacket portion, and the annular connecting edge of the calotte-shaped case bottom portion forms the end of the cylindrical case bottom portion facing the cylindrical case jacket portion.

13. The case jacket according to claim 9, wherein a wall thickness at the bottom-side end of the cylindrical case jacket portion is equal to a wall thickness of the connecting ring of the calotte-shaped case bottom portion.

14. The case jacket according to claim 13, wherein, in that except for a chamfer at the end of the cylindrical case jacket portion facing away from the bottom, the case jacket has a constant wall thickness both in circumferential direction and in longitudinal direction.

15. The case jacket according to claim 9, wherein a textile fabric is embedded in the wall of the cylindrical case jacket portion.

16. The case jacket according to claim 9, wherein the calotte-shaped case bottom is configured to be assembled with a bottom such that, when assembled, the calotte-shaped case bottom resides within a cavity defined by the bottom and the conical connecting portion resides outside of the cavity.

17. An ammunition assembly comprising:

a bottom defining a cavity; and a case jacket having a cylindrical case jacket portion, a calotte-shaped case bottom portion, and a conical connecting portion that joins the cylindrical case jacket portion with the calotte-shaped case bottom portion, wherein the case jacket is configured to couple with the bottom via the calotte-shaped case bottom portion such that the calotte-shaped case bottom resides within the cavity and the conical connecting portion resides outside of the cavity, wherein a bottom-side end of the cylindrical case jacket portion defines a first inside diameter and a first outside diameter, wherein an annular connecting edge of the calotte-shaped case bottom portion defines a second inside diameter that is smaller than the first inside diameter and a second outside diameter that is smaller than the first outside diameter, wherein a first end of the conical connecting portion is connected to the bottom-side end and a second end of the conical connecting portion is connected to the annular connecting edge, and wherein an angle of inclination of a wall between the first end and the second end is 10 degrees or less relative to a cylinder axis of the conical connecting portion.

18. The ammunition assembly according to claim 17, wherein the angle of inclination of the wall is 7 degrees or less.

19. The ammunition assembly according to claim 17, wherein the angle of inclination of the wall is 3 degrees or less.

20. The ammunition assembly according to claim 17, wherein the calotte-shaped case bottom portion has a cylindrical case bottom portion on its side facing the cylindrical case jacket portion, and the annular connecting edge of the calotte-shaped case bottom portion forms the end of the cylindrical case bottom portion facing the cylindrical case jacket portion.

* * * * *